US009816350B2

(12) United States Patent
Mailand et al.

(10) Patent No.: US 9,816,350 B2
(45) Date of Patent: Nov. 14, 2017

(54) DELAYED OPENING PRESSURE ACTUATED PORTED SUB FOR SUBTERRANEAN USE

(71) Applicant: BAKER HUGHES INCORPORATED, Houston, TX (US)

(72) Inventors: Jason C. Mailand, The Woodlands, TX (US); Christopher K. Elliott, Houston, TX (US); Tyler C. Roberts, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 576 days.

(21) Appl. No.: 14/270,045

(22) Filed: May 5, 2014

(65) Prior Publication Data

US 2015/0315873 A1 Nov. 5, 2015

(51) Int. Cl.

| | |
|---|---|
| ***E21B 34/12*** | (2006.01) |
| ***E21B 34/10*** | (2006.01) |
| ***E21B 34/06*** | (2006.01) |
| *E21B 34/00* | (2006.01) |

(52) U.S. Cl.

CPC ..... *E21B 34/108* (2013.01); *E21B 34/063* (2013.01); *E21B 34/125* (2013.01); *E21B 2034/007* (2013.01)

(58) Field of Classification Search

CPC .. E21B 2034/007; E21B 34/12; E21B 34/063; E21B 34/125

USPC ..... 166/317, 376, 334.4

See application file for complete search history.

(56) References Cited

U.S. PATENT DOCUMENTS

| | | | |
|---|---|---|---|
| 3,189,044 | A | 6/1965 | Sizer |
| 3,442,328 | A | 5/1969 | Nutter |
| 3,570,594 | A | 3/1971 | Hamilton |
| 3,662,834 | A | 5/1972 | Young |
| 3,896,667 | A | 7/1975 | Jeter |

(Continued)

FOREIGN PATENT DOCUMENTS

| | | | |
|---|---|---|---|
| WO | 2009105128 | A1 | 8/2009 |
| WO | 2012115868 | A2 | 8/2012 |
| WO | 2012145735 | A1 | 10/2012 |

OTHER PUBLICATIONS

Delta Stim Initiator Valve Drawing, HAL24633, Date unknown, 1 page.

(Continued)

*Primary Examiner* — Giovanna C Wright

(74) *Attorney, Agent, or Firm* — Steve Rosenblatt

(57) ABSTRACT

A ported sub is operated with a pressure actuated shifting sleeve. A first rupture disc is set at a lower pressure than the test pressure for the tubing string that houses the ported sub. The first rupture disc breaks at a lower pressure than the string test pressure to expose well fluids to a disintegrating plug. The plug slowly disintegrates to then expose tubing pressure to a chamber and a second rupture disc with the chamber configured to have no effect on moving the sliding sleeve. When the tubing pressure is then raised to a predetermined pressure below the test pressure for the string, the second disc breaks exposing a piston to tubing pressure on one side and trapped low pressure being the opposite side of the string. The differential moves the sleeve to open a port to let tools be pumped into position without a need to perforate.

24 Claims, 4 Drawing Sheets

(56) References Cited

U.S. PATENT DOCUMENTS

| | | | | |
|---|---|---|---|---|
| 3,930,540 | A | 1/1976 | Holden et al. | |
| 3,964,544 | A | 6/1976 | Farley et al. | |
| 3,986,554 | A | 10/1976 | Nutter | |
| 4,109,724 | A | 8/1978 | Barrington | |
| 4,257,484 | A | 3/1981 | Whitley et al. | |
| 4,330,039 | A | 5/1982 | Vann et al. | |
| 4,403,659 | A | 9/1983 | Upchurch | |
| 4,434,854 | A | 3/1984 | Vann et al. | |
| 4,691,779 | A | 9/1987 | McMahan et al. | |
| 4,718,494 | A | 1/1988 | Meek | |
| 4,970,655 | A | 11/1990 | Winn et al. | |
| 4,979,569 | A | 12/1990 | Anyan et al. | |
| 4,991,654 | A | 2/1991 | Brandell et al. | |
| 5,044,444 | A | 9/1991 | Coronado | |
| 5,325,917 | A | 7/1994 | Szarka | |
| 5,355,959 | A | 10/1994 | Walter et al. | |
| 5,425,424 | A * | 6/1995 | Reinhardt | E21B 33/16 166/291 |
| 5,649,597 | A | 7/1997 | Ringgenberg | |
| 5,810,087 | A | 9/1998 | Patel | |
| 5,819,853 | A | 10/1998 | Patel | |
| 5,840,087 | A | 11/1998 | Gozdz et al. | |
| 5,950,733 | A | 9/1999 | Patel | |
| 5,954,135 | A | 9/1999 | Williamson et al. | |
| 6,035,880 | A | 3/2000 | Gazda | |
| 6,186,227 | B1 | 2/2001 | Vaynshteyn et al. | |
| 6,286,594 | B1 | 9/2001 | French | |
| 6,293,346 | B1 | 9/2001 | Patel | |
| 6,308,783 | B2 | 10/2001 | Pringle et al. | |
| 6,386,289 | B1 | 5/2002 | Patel | |
| 6,470,970 | B1 | 10/2002 | Purkis et al. | |
| 6,550,541 | B2 | 4/2003 | Patel | |
| 6,604,583 | B1 | 8/2003 | Van Randen | |
| 6,659,186 | B2 | 12/2003 | Patel | |
| 6,684,950 | B2 | 2/2004 | Patel | |
| 6,722,469 | B1 | 4/2004 | Weger, Jr. | |
| 6,945,331 | B2 | 9/2005 | Patel | |
| 6,948,561 | B2 | 9/2005 | Myron | |
| 7,562,713 | B2 | 7/2009 | Basmajian et al. | |
| 7,640,988 | B2 | 1/2010 | Phi et al. | |
| 7,703,510 | B2 | 4/2010 | Xu | |
| 7,762,324 | B2 | 7/2010 | Clem | |
| 7,841,412 | B2 | 11/2010 | Jasser et al. | |
| 7,845,416 | B2 | 12/2010 | Turner et al. | |
| 7,909,095 | B2 | 3/2011 | Richards et al. | |
| 7,913,770 | B2 | 3/2011 | Schramm et al. | |
| 8,171,994 | B2 | 5/2012 | Murray et al. | |
| 8,267,178 | B1 * | 9/2012 | Sommers | E21B 34/102 166/317 |
| 8,276,670 | B2 | 10/2012 | Patel | |
| 8,555,960 | B2 | 10/2013 | Mailand | |
| 2004/0045724 | A1 | 3/2004 | Buyers et al. | |
| 2008/0066923 | A1 | 3/2008 | Xu | |
| 2009/0071642 | A1 | 3/2009 | Moyes | |
| 2010/0200243 | A1 | 8/2010 | Purkis | |
| 2010/0236781 | A1 | 9/2010 | Mytopher et al. | |
| 2010/0314562 | A1 * | 12/2010 | Bisset | E21B 34/06 251/12 |
| 2011/0056679 | A1 | 3/2011 | Rytlewski | |
| 2011/0100643 | A1 | 5/2011 | Themig et al. | |
| 2011/0114324 | A1 | 5/2011 | Hayter et al. | |
| 2011/0278017 | A1 | 11/2011 | Themig et al. | |
| 2012/0006553 | A1 | 1/2012 | Korkmaz | |
| 2012/0048559 | A1 | 3/2012 | Ganguly et al. | |
| 2012/0138311 | A1 | 6/2012 | Stout | |
| 2012/0186803 | A1 | 7/2012 | Xu et al. | |
| 2012/0211242 | A1 | 8/2012 | Patel | |
| 2012/0267119 | A1 | 10/2012 | Patel | |
| 2012/0279723 | A1 * | 11/2012 | Hofman | E21B 34/063 166/373 |
| 2012/0285702 | A1 | 11/2012 | Rytlewski | |
| 2013/0062124 | A1 | 3/2013 | Roders et al. | |
| 2014/0102703 | A1 | 4/2014 | Mailand | |
| 2014/0251620 | A1 * | 9/2014 | George | E21B 34/108 166/305.1 |
| 2016/0237781 | A1 * | 8/2016 | Bacsik | E21B 34/063 |

OTHER PUBLICATIONS

Schlumberger, KickStart Rupture Disc Valve, Date unknown, 1 page.

McCoy, J.N., et al., "Timer Control of Beam Pump Run Time Reduces Operating Expense", Presented at the Forty-Sixth Annual Southwestern Petroleum Short Course in Lubbock, Texas, Apr. 21-22, 1999, 16 pages.

* cited by examiner

DELAYED OPENING PRESSURE ACTUATED PORTED SUB FOR SUBTERRANEAN USE

FIELD OF THE INVENTION

The field of the invention is pressure operated ported subs opened with sleeve movement and more particularly where the sleeve is actuated with a delay to allow a pressure test of a string followed by sleeve actuation at a far lower pressure than the string test pressure.

BACKGROUND OF THE INVENTION

In the past, pressure actuated sleeves have been protected from setting pressures with a rupture disc that is set at a higher pressure than the string test pressure, as described in U.S. Pat. No. 8,555,960. US Publication 2014/0102703 uses pressure cycles and an indexing device with Belleville washers to selectively open a sliding sleeve. U.S. application Ser. No. 14/080544 discusses using timers or sensors to operate a ported sleeve without any detailed description as to how this is to be accomplished.

Timers and signal devices add complexity and expense and the present invention accomplishes a time delay economically and reliably. A disintegrating plug is first exposed to well fluids during the pressure test of the string. After a time the plug disintegrates sufficiently to allow tubing pressure access to a second rupture disc mounted in a pressure balanced chamber. Then when it is desired to shift the sleeve the second rupture disc is deliberately broken at a lower pressure level than the test pressure to allow entry of tubing pressure to a piston that is referenced to a low pressure such as atmospheric. The large differential pressure on the piston then shifts the sleeve. The opening of the ports provides formation access for a variety of operations such as fracturing, acidizing, injecting or conditioning. These and other aspects of the present invention will be more readily apparent to those skilled in the arts from a review of the description of the preferred embodiment and the associated drawings while recognizing that the full scope of the invention is to be determined by the appended claims.

SUMMARY OF THE INVENTION

A ported sub is operated with a pressure actuated shifting sleeve. A first rupture disc is set at a lower pressure than the test pressure for the tubing string that houses the ported sub. The first rupture disc breaks at a lower pressure than the string test pressure to expose well fluids to a disintegrating plug. The plug disintegrates over time to then expose tubing pressure to a chamber and a second rupture disc with the chamber configured to have no effect on moving the sliding sleeve. When the tubing pressure is then raised to a predetermined pressure below the test pressure for the string, the second disc breaks exposing a piston to tubing pressure on one side and trapped low pressure being the opposite side of the string. The differential moves the sleeve to open a port to let tools be pumped into position without a need to perforate.

DETAILED DESCRIPTION OF THE PREFERRED EMBODIMENT

Figure 1:
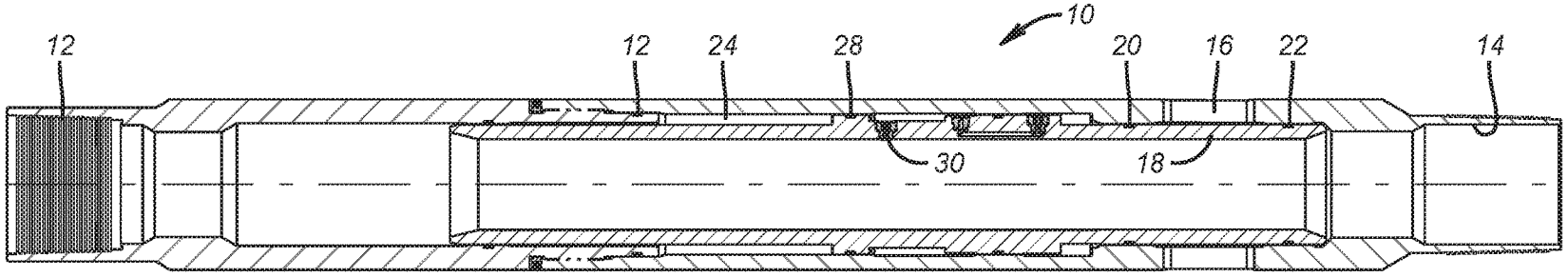
FIG. 1 is a section view of the pressure actuated sliding sleeve ported sub.
Figure 1A:
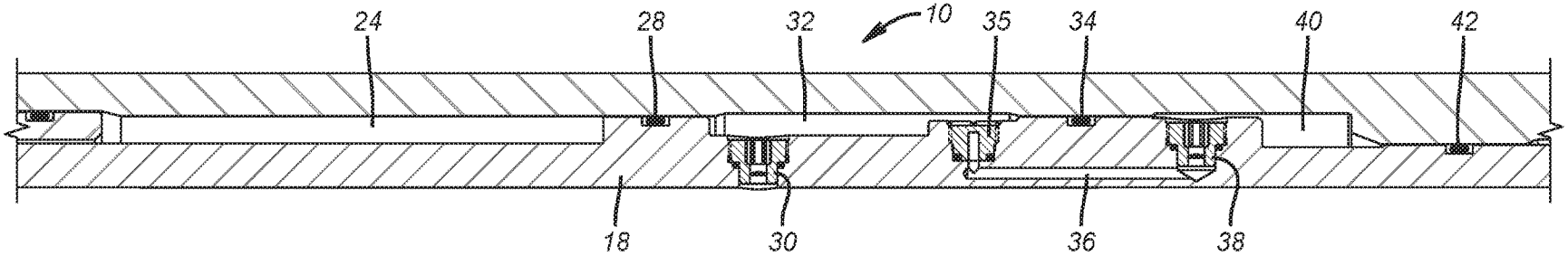
FIG. 1*a* is a closer view of the rupture discs and plug of FIG. 1.
Figure 4:
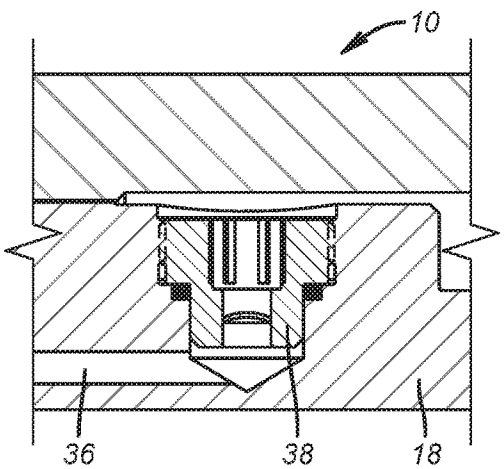
FIG. 4 is a section view of the second rupture disc.
Figure 3:
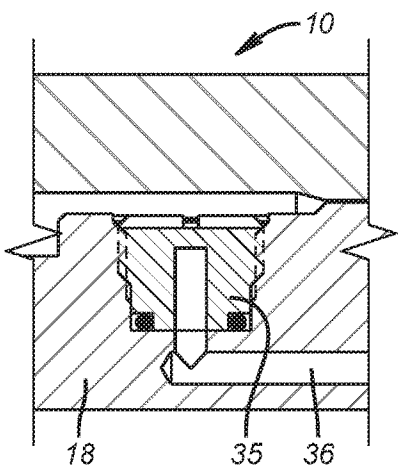
FIG. 3 is a section view of the disintegrating plug between rupture discs.
Figure 2:
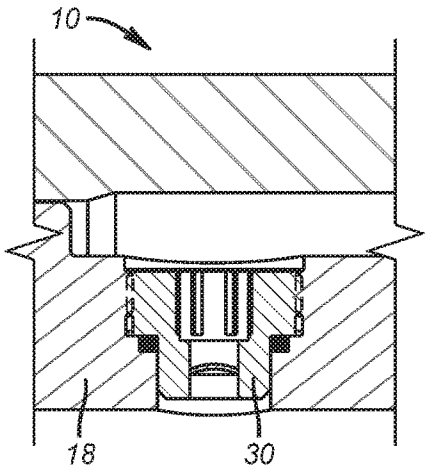
FIG. 2 is a section view of the first rupture disc.

Referring to FIG. 1 the housing 10 has end connections 12 and 14 to connect to a tubular string that is not shown. Housing 10 has ports 16 that are initially closed by sleeve 18 with seals 20 and 22 straddling ports 16. A low pressure variable volume chamber 24 is defined between sleeve 18 and housing 10 as well as seals 26 and 28. Seal 26 is on housing 10 and seal 28 moves with sleeve 18. A first rupture disc 30 is set for a pressure below the intended test pressure for the tubular string that is connected at end connections 12 and 14. Behind rupture disc 30 is a variable volume chamber 32 defined by the housing 10, the sleeve 18, seal 28 and seal 34 that are both mounted to the sleeve 18. A disintegrating plug 35 initially isolates chamber 32 from passage 36 that leads to the second rupture disc 38. Variable volume chamber 40 is defined by housing 10, sleeve 18, seal 34 and seal 42. Seal 34 and seal 42 are on the sleeve 18. Chamber 24 is at low or atmospheric pressure.

Figure 5:
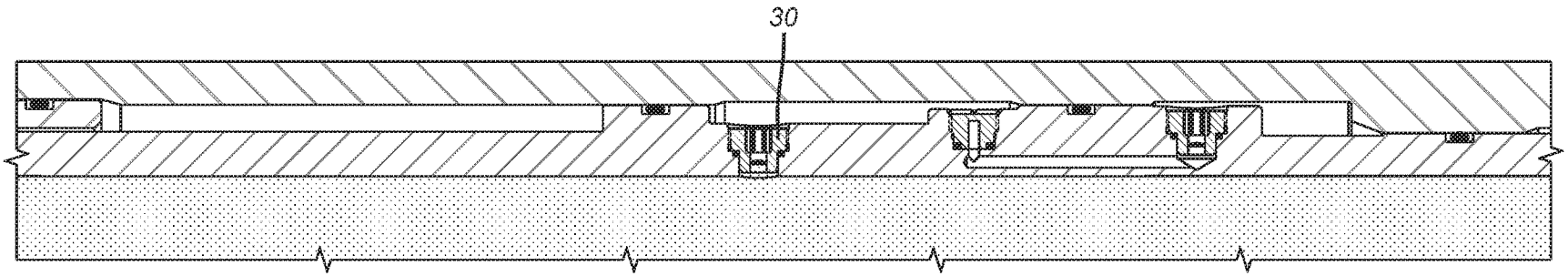
FIG. 5 is the view of FIG. 1 with tubing pressure applied.
Figure 6:
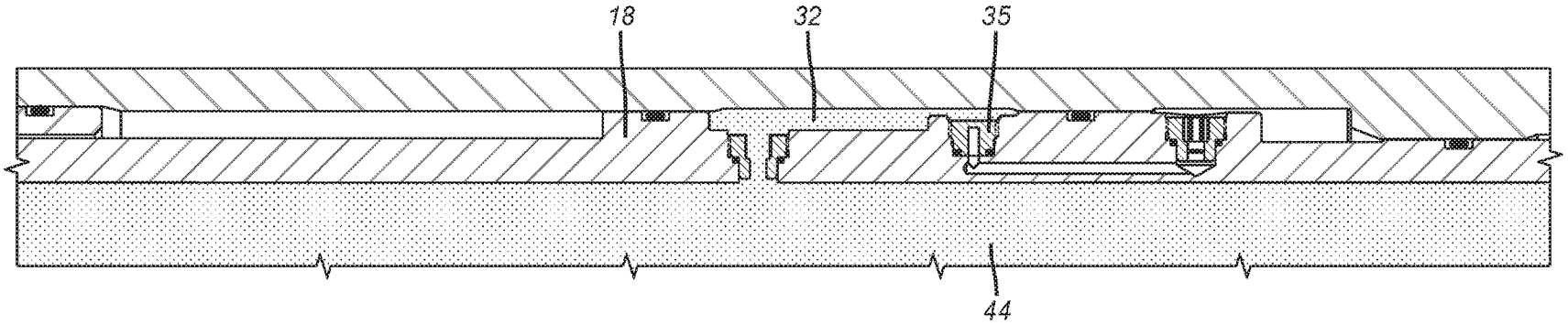
FIG. 6 is the view of FIG. 5 with the first rupture disc broken during a pressure test of the string.
Figure 7:
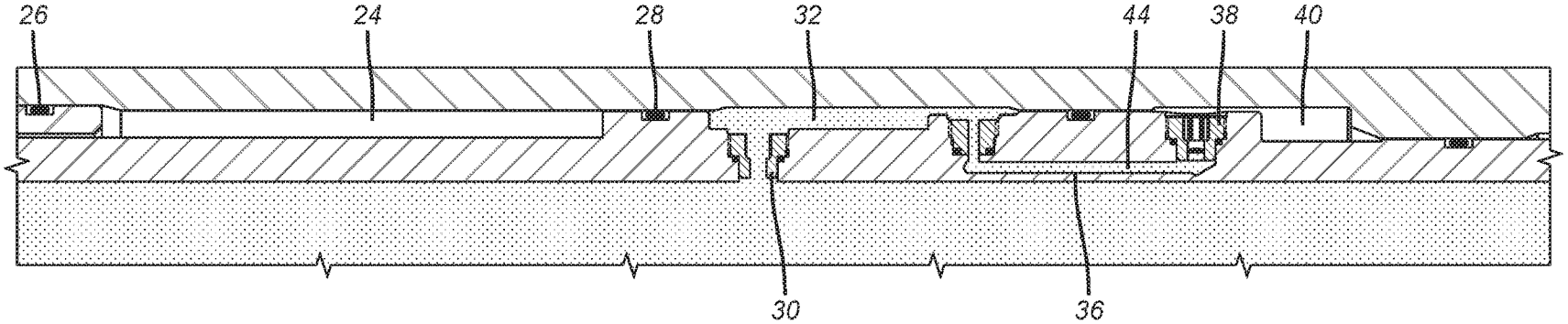
FIG. 7 is the view of FIG. 6 with the disintegrating plug compromised.
Figure 8:
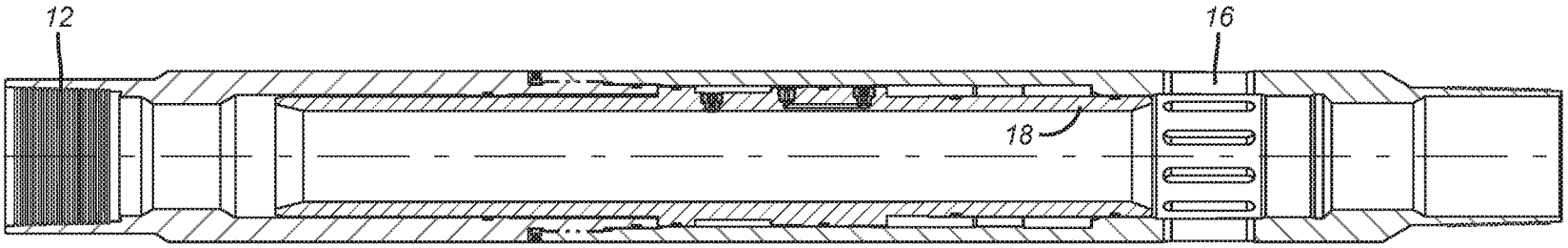
FIG. 8 is a shifted view of the sliding sleeve of FIG. 1.
Figure 8A:
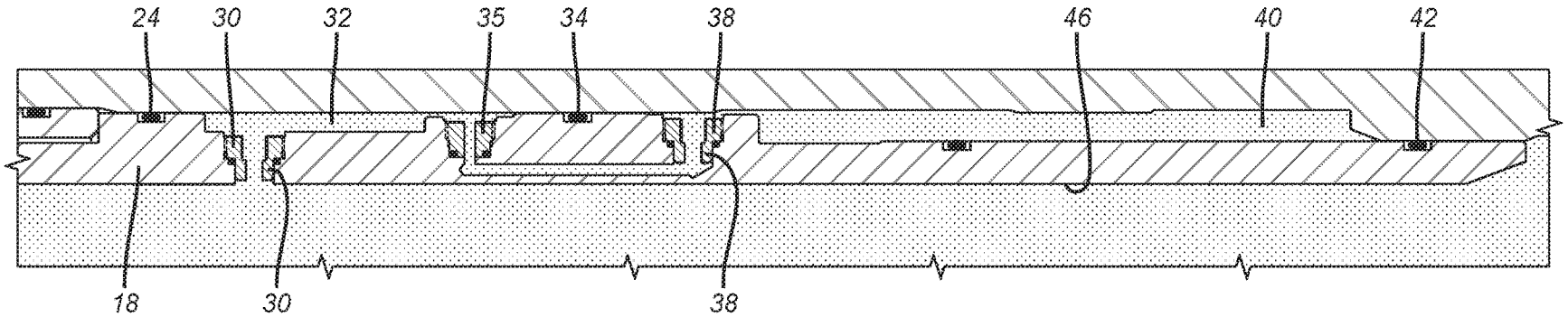
FIG. 8*a* is a closer view of parts of the sliding sleeve of FIG. 8.

The operation of the tool begins with FIG. 5. The pressure is built up to the tubing string test pressure which is higher than the burst pressure of the first rupture disc 30. In FIG. 6 the rupture disc 30 breaks to allow tubing fluid 44 into chamber 32. Sleeve 18 is in force balance from pressure migrating into chamber 32 so it still does not move. The tubing pressure is raised to the desired string test pressure with the first rupture disc now broken. However, now the disintegrating plug 35 is starting to break up as a result of exposure to tubing fluids. The pressure test is designed to end before the plug 35 is undermined. This allows the tubing pressure to be lowered first before the disintegration of plug 35 can open passage 36. FIG. 7 shows the plug has been undermined to open passage 36 to tubing fluid 44. Although well fluid 44 is at second rupture disc 38 that disc does not break because the tubing pressure has in the interim been reduced to below the burst pressure of disc 38. At a later time when it is desired to open the ports 16 the pressure in housing 10 is raised to above the burst pressure of the rupture disc 38 to allow the tubing fluid and pressure 44 to reach chamber 40 as shown in FIG. 8*a*. At this point the pressure in chamber 40 pushes on a piston area defined by the diameter difference of seals 42 and 34 and the resisting force in the opposite direction is the low pressure in chamber 24 acting on a piston area that is the diameter difference between seals 28 and 26 which is designed to be negligible. As a result, sleeve 18 moves quickly to open ports 16, as shown in FIG. 8.

An application of the pressure operated sleeve is in a cemented casing where circulation needs to be established to allow pumping down equipment particularly in a horizontal portion of a borehole. Perforation is not needed to open up such a circulation path. The pressure actuated sleeve can be placed just above a cement shoe so that pressure can be built up to the string test pressure and on the way to that pressure the first rupture disc breaks and starts the clock in a sense on the disintegration of the plug. The plug can be made of different materials depending on the time needed to conduct the pressure test to conclusion and then reduce the tubing pressure. One such material is a controlled electrolytic material (CEM) that has been described in US Publication 2011/0136707 and related applications filed the same day. US Publication 2011/0136707 and the related applications are incorporated by reference herein as though fully set forth. Other materials that disintegrate or otherwise fail from exposure to well fluids, heat or fluids added to a well can also be employed to get the desired delay time. After the delay with the tubing pressure lowered a decision can be made to actuate the sleeve 18 by raising the tubing pressure above the burst pressure of the second rupture disc. This pressurizes chamber 40 to push sleeve 18 against minimal resistance from chamber 24. The use of low pressure chamber 24 allows the sleeve to be made thicker with no loss of drift dimension represented by its inner wall 46 because the required piston area is diminished by the large pressure differential between chambers 40 and 24. The sleeve is then less likely to distort because it has a heavier wall with little to no loss of drift dimension through the sleeve 18.

The above description is illustrative of the preferred embodiment and many modifications may be made by those skilled in the art without departing from the invention whose scope is to be determined from the literal and equivalent scope of the claims below:

We claim:

1. A circulation sub assembly for a tubular string, comprising:

a housing having a passage therethrough and at least one wall opening selectively covered by a pressure responsive movable member;

said member further comprising an actuation system that is selectively isolated, from housing pressure that would move said member, for a predetermined time to conduct a tubular string pressure test with housing pressure from said pressure test removing an initial barrier of the actuation system followed by a lowering of pressure at the conclusion of the tubing string pressure test;

whereupon, after a delay and lowering of pressure said actuation system is exposed to tubing pressure with a selective removal of a secondary barrier of the actuation system in a manner to move said member to open said at least one wall opening.

2. The assembly of claim 1, wherein:

said member comprises a sleeve.

3. The assembly of claim 1, wherein:

said actuation system comprises at least one rupture disc.

4. The assembly of claim 1, wherein:

said actuation system comprises at least one disintegrating or otherwise failing plug.

5. The assembly of claim 4, wherein:

said plug is initially isolated from fluid in said housing.

6. The assembly of claim 5, wherein:

said plug is exposed to fluid in said housing as a result of an initial pressure increase toward a test pressure for the tubing string which removes said initial barrier.

7. The assembly of claim 6, wherein:

said initial pressure increase breaks said initial barrier which further comprises a first rupture disc to allow fluids in said housing to reach said plug.

8. The assembly of claim 7, wherein:

breaking of said first rupture disc does not apply a sufficient force to move said member.

9. A method of using the apparatus of claim 1 to gain access to a formation, comprising:

locating the apparatus of claim 1 near a formation;

exposing the actuation system to tubing pressure;

opening said at least one wall opening.

10. The method of claim 9, comprising:

performing a treatment on the formation through said at least one wall opening after said opening.

11. The method of claim 10, comprising:

performing fracturing, acidizing, injecting or conditioning as said treating the formation.

12. A circulation sub assembly for a tubular string, comprising:

a housing having a passage therethrough and at least one wall opening selectively covered by a pressure responsive movable member;

said member further comprising an actuation system that is selectively isolated, from housing pressure that would move said member, for a predetermined time to conduct a tubular string pressure test followed by a lowering of pressure at the conclusion of the tubing string pressure test;

whereupon, after a delay and lowering of pressure said actuation system is exposed to tubing pressure in a manner to move said member to open said at least one wall opening;

said actuation system comprises at least one disintegrating or otherwise failing plug;

said plug is initially isolated from fluid in said housing;

said plug is exposed to fluid in said housing as a result of an initial pressure increase toward a test pressure for the tubing string;

said initial pressure increase breaks a first rupture disc to allow fluids in said housing to reach said plug;

breaking of said first rupture disc does not apply a sufficient force to move said member;

disintegration or otherwise failing of said plug exposes a second rupture disc to pressure in said housing without applying a sufficient force to move said member.

13. The assembly of claim 12, wherein:

breaking of said second rupture disc after disintegration or otherwise failing of said plug allows pressure into said housing to reach an actuation variable volume chamber to move said member.

14. The assembly of claim 13, wherein:

said actuation variable volume chamber defining a piston that is exposed to housing pressure;

said piston is referenced to a reference variable volume chamber that is initially at essentially atmospheric pressure.

15. The assembly of claim 14, wherein:

an initial pressure difference between said cavities allows said member that further comprises a sleeve to have a thicker wall and smaller piston area than would be needed if said reference variable volume chamber was at a pressure above essentially atmospheric.

16. A circulation sub assembly for a tubular string, comprising:

a housing having a passage therethrough and at least one wall opening selectively covered by a pressure responsive movable member;

said member further comprising an actuation system that is selectively isolated, from housing pressure that would move said member, for a predetermined time to conduct a tubular string pressure test followed by a lowering of pressure at the conclusion of the tubing string pressure test;

whereupon, after a delay and lowering of pressure said actuation system is exposed to tubing pressure in a manner to move said member to open said at least one wall opening;

said actuation system comprises at least one rupture disc;

said actuation system comprises at least one disintegrating or otherwise failing plug;

said at least one rupture disc comprises spaced rupture discs with said plug initially blocking fluid communication between said rupture discs.

17. The assembly of claim 16, wherein:

said plug is initially isolated from fluid in said housing.

18. The assembly of claim 17, wherein:

said plug is exposed to fluid in said housing as a result of an initial pressure increase toward a test pressure for the tubing string.

19. The assembly of claim 18, wherein:

said initial pressure increase breaks a first said rupture disc to allow fluids in said housing to reach said plug.

20. The assembly of claim 19, wherein:

breaking of said first rupture disc does not apply a sufficient force to move said member.

21. The assembly of claim 20, wherein:

disintegration or otherwise failing of said plug exposes a second said rupture disc to pressure in said housing without applying a sufficient force to move said member.

22. The assembly of claim 21, wherein:

breaking of said second rupture disc after disintegration or otherwise failing of said plug allows pressure into said housing to reach an actuation variable volume chamber to move said member.

23. The assembly of claim 22, wherein:

said actuation variable volume chamber defining a piston that is exposed to housing pressure;

said piston is referenced to a reference variable volume chamber that is initially at essentially atmospheric pressure.

24. The assembly of claim 23, wherein:

an initial pressure difference between said cavities allows said member, which further comprises a sleeve, to have a thicker wall and smaller piston area than would be needed if said reference variable volume chamber was at a pressure above essentially atmospheric.

* * * * *